US009692161B2

(12) United States Patent
Lindkamp et al.

(10) Patent No.: US 9,692,161 B2
(45) Date of Patent: Jun. 27, 2017

(54) WIRE AND CIRCUIT BOARD ELECTRICAL CONNECTOR

(71) Applicant: HARTING Electronics GmbH, Espelkamp (DE)

(72) Inventors: Marc Lindkamp, Luebbecke (DE); Guenter Pape, Enger (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 14/908,460

(22) PCT Filed: Sep. 3, 2014

(86) PCT No.: PCT/DE2014/100317
§ 371 (c)(1),
(2) Date: Jan. 28, 2016

(87) PCT Pub. No.: WO2015/035979
PCT Pub. Date: Mar. 19, 2015

(65) Prior Publication Data

US 2016/0190720 A1 Jun. 30, 2016

(30) Foreign Application Priority Data

Sep. 13, 2013 (DE) ..... 10 2013 110 082

(51) Int. Cl.
*H01R 12/75* (2011.01)
*H01R 12/72* (2011.01)
(Continued)

(52) U.S. Cl.
CPC ..... *H01R 12/75* (2013.01); *H01R 4/2429* (2013.01); *H01R 4/2433* (2013.01); *H01R 9/031* (2013.01);
(Continued)

(58) Field of Classification Search
CPC ... H01R 12/721; H01R 4/2416; H01R 4/2454
(Continued)

(56) References Cited

U.S. PATENT DOCUMENTS 4,449,767 A * 5/1984 Weidler ..... H01R 13/6456 439/357
4,975,077 A * 12/1990 Kato ..... H01R 4/242 439/395
(Continued)

FOREIGN PATENT DOCUMENTS

DE 202011101050 6/2011 ..... H01R 12/72
WO WO 2007102983 9/2007 ..... H01R 9/24
WO WO 2009052965 4/2009 ..... H01R 12/20

OTHER PUBLICATIONS

DE202011101050_translation.*
(Continued)

*Primary Examiner* — Tulsidas C Patel
*Assistant Examiner* — Marcus Harcum
(74) *Attorney, Agent, or Firm* — Hayes Soloway P.C.

(57) ABSTRACT

Provided a connector for establishing an electrical connection between an electrical conductor and a printed circuit board. The connector includes an insulating element which has a plurality of cavities for accommodating contact elements. The printed circuit board can be inserted in the connector via a slot in a connection face of the insulating element and can be connected to the first contact faces of the contact element provided in the connection face. Opposite the first contact face, the contact elements have a second contact face which is provided for the insulation-piercing contacting of the electrical conductor. The arrangement of the contact elements in the insulating element allows a particularly space-saving design of the connector.

15 Claims, 7 Drawing Sheets

(51) Int. Cl.

| | |
|---|---|
| ***H01R 9/03*** | (2006.01) |
| *H01R 4/24* | (2006.01) |
| *H01R 13/24* | (2006.01) |
| *H01R 13/436* | (2006.01) |

(52) U.S. Cl.
CPC ..... *H01R 12/721* (2013.01); *H01R 4/2416* (2013.01); *H01R 13/2435* (2013.01); *H01R 13/4368* (2013.01)

(58) Field of Classification Search
USPC ..... 439/636, 395
See application file for complete search history.

(56) References Cited

U.S. PATENT DOCUMENTS 5,980,337 A * 11/1999 Little ..... H01R 13/11 439/857
6,135,804 A * 10/2000 Lux ..... H01R 4/2433 439/397
6,280,230 B1 * 8/2001 Takase ..... H01R 4/245 439/395
8,277,262 B2 10/2012 Busse ..... 439/719
2005/0130509 A1 * 6/2005 Yang ..... H01R 12/57 439/851
2008/0305651 A1 12/2008 Mostoller et al. ..... 439/62
2010/0197163 A1 * 8/2010 Ofenloch ..... H01R 4/2462 439/406
2010/0227489 A1 * 9/2010 Yu ..... H01R 13/635 439/153
2012/0072047 A1 3/2012 Forwerck et al. ..... 701/1
2013/0017712 A1 * 1/2013 Liu ..... H01R 13/2442 439/391

OTHER PUBLICATIONS

English translation of International Preliminary Report on Patentability issued in corresponding PCT Patent Appln. Serial No. PCT/DE2014/100317 dated Mar. 15, 2016 (10 pages).
International Search Report and Written Opinion issued in application No. PCT/DE2014/100317, dated Dec. 17, 2014 (13 pgs).

* cited by examiner

WIRE AND CIRCUIT BOARD ELECTRICAL CONNECTOR

BACKGROUND OF THE INVENTION

The invention relates to a connector for contacting an electrical conductor and a circuit board.

Connectors are used to separate and connect lines, which in particular are designed to convey electrical current. Connectors of this type usually have an insulating body with contact elements received therein. Here, the insulating bodies are designed in such a way that they have a connection side for the connection of electrical lines and an insertion side for coupling to an electrical component or a further connector.

The present invention relates to connectors which are provided in order to connect an electrical line to a PC board or what is known as a PCB (printed circuit board). These special connectors are required in order to electrically conductively contact a line and a PC board. Here, the contact elements received in the connector ensure the electrical connection of in each case a core of the electrical line and at least one, preferably two contact tracks provided n the PC board.

Connectors of this type previously had some disadvantages that were not insignificant. Connectors of the described type are primarily very laborious in terms of their assembly. The line to be connected must be prepared for contact with the connector. For this purpose, the insulated line cores usually have to be exposed. These are then to be connected individually to the contact elements of the connector in order to ensure an electrically conductive connection thereto. Once the line cores have been connected to the contact elements, these must be introduced into the insulating body and locked in place therein. The components of the connector which enable contact between electrical line and the connector are generally very complex.

A further disadvantage of the solution previously known from the prior art is constituted by the fact that connectors of this type usually require a mating connector in order to be connected to a circuit board. The mating connector must be soldered on or pressed onto the PC board at the appropriate point. The connector can be connected to the mating connector following prior assembly as described above. This is an additional component which has to be produced and assembled and additionally increases the cost of a plug-in connection accordingly.

In addition, the plug-in connection is made very large by the use of a further connector. The additional mating connector requires additional space. Particularly in very small assemblies, this may lead to problems in terms of the space for example for the cable guide.

SUMMARY OF THE INVENTION

The object of the invention is therefore to overcome or to mitigate at least one of the above-mentioned problems, and in particular a connector is to be provided which has very small dimensions and can be contacted with a PC board without a mating connector.

The invention relates to an electrical connector for electrically contacting an electrical conductor and an electrical PC board, or what is known as a PCB (printed circuit board). Connectors of this type are required in order to contact the electrical cores of the electrical conductor guiding signals and/or current with contact points on the PCB.

For this purpose, the connector consists substantially of an insulating housing which is formed by an insulating body. The insulating body has a number of cavities, which are provided in order to receive electrical contact elements. The contact elements are provided here in order to directly contact the individual cores of the conductor with the contact points of the PCB.

The insulating body consisting of a T-shaped component extruded into the space forms an insertion side, which is provided for insertion onto the board edge of a PCB, and a contact side, which is suitable for contacting the electrical conductor. The insertion side has a slot, into which the PCB can be inserted.

In a preferred embodiment detent shapings are formed on the inner side of the slot and enable the insulating body to be latched to the PCB. For this purpose, the detent shapings are wedge-shaped or dome-like. These detent shapings can engage with bores or similar recesses in the PCB and can thus position the connector on the PCB and prevent said connector from shifting.

The PCB is for this purpose expediently provided with continuous bores, blind bores, or also rectangular or triangular recesses or recesses of a different shape. The detent shapings of the connector can engage with these recesses.

The contact side of the insulating body in a preferred embodiment has at least one cable-receiving channel. The cable-receiving channel formed as a bore is provided in order to receive an insulated stranded wire or core of the electrical conductor. A cable-receiving channel is preferably provided for each core of the electrical conductor.

In a particularly preferred embodiment the electrical conductor is formed as what is known as a flat ribbon cable. This is characterized in that all cores of the conductor are arranged side by side. A flat cable or what is known as a flat ribbon cable is produced as a result of a common insulation of the cores.

Due to the special arrangement of the cable-receiving channels side by side, such that these overlap one another in regions, the flat ribbon cable can be introduced into the cable-receiving channels such that precisely one core of the flat ribbon cable is received in each channel.

The cavities provided in the insulating body expediently extend both into the insertion side and into the contact side of the insulating body. In the insertion side the cavities each form an insertion region, and in the contact side they each form a contact region.

The insertion regions of the cavities are arranged such that they intersect the slot for receiving the PCB, preferably at right angles. A PCB inserted into the slot thus penetrates all insertion regions uniformly.

The contact regions of the cavities are arranged irregularly, in contrast to the insertion regions. The contact regions of the various cavities are provided here such that in each case a contact region intersects a cable-receiving channel for the line cores.

In a preferred embodiment the cavities are designed such that two cavities are always identical, but mirror-inverted relative to one another. For example, in the case of four cavities, the two outer cavities would thus be mirror-inverted relative to one another and would intersect the uppermost and lowermost cable-receiving channel respectively, and the two inner cavities would intersect the two middle cable-receiving channels.

The embodiment of in each case two identical cavities arranged in a mirrored manner serves to reduce the contact elements which must be held available in order to be received in the cavities.

The contact elements provided to be received in the cavities are preferably contacts stamped from sheet metal. These have two contact sides: a first contact side, which is arranged in the insertion region of the cavity, and a second contact side, which is arranged in the contact region of the cavity.

The first contact side of the contact element is substantially fork-shaped by two contact arms. The contact arms each form a contact point. The contact arms are also arranged in the contact region of the cavity such that the slot is guided through between the contact arms and only the contact points of the contact arms protrude into the slot.

The second contact side of the contact element is provided for insulation-penetrating contact. This can be provided either by what is known as piercing contact, or in a preferred embodiment by an insulation-displacement connector. The second contact side is arranged in the contact region of the cavity such that the second contact side protrudes into the cable-receiving channel, which intersects the contact region. Insulation-penetrating contact of a conductor disposed in the cable-receiving channel is thus possible.

The contact elements are advantageously provided in various embodiments. These differ from one another in terms of where the second contact side is provided on the first contact side. This is dependent for each contact element individually on the cavity in which the contact element is received. As already presented above, the contact region is provided in each cavity in a different position in order to intersect a different core of the electrical conductor. The contact elements are adapted accordingly.

The contact elements expediently have at least one, advantageously two detent means. These are provided on the contact elements such that they engage with an undercut, which is expediently provided, in the cavity in the insulating body. The contact element is thus prevented from falling out of the cavity of the insulating body.

The cavity in the insulating body is advantageously open in the region of the insertion side so as to be able to insert the contact element into the cavity. By inserting the contact element into the cavity, a core arranged in the cable-receiving channel is contacted in an insulation-penetrating manner by the second contact side of the contact element.

In a progressive embodiment the insulating body of the connector is formed in two parts. Here, the insulating body consists of a main body and a cable manager. The main body here comprises substantially the insertion side of the insulating body. The cable manager serves to receive the electrical conductor and forms the contact side of the insulating body.

The insertion region of the cavity is provided in the main body of the two-part insulating body. In addition, the slot intersecting the insertion region acts for receiving and being inserted onto a PCB. In contrast to a one-part insulating body, the cavity here does not have an opening in the insertion region for the insertion of the contact element into the insulating body. Due to the two parts of the insulating body, the contact element is introduced via the cutting plane of the two parts into the insulating body, preferably into the main body.

The contact region of the cavities provided in the cable manager, which forms the second part of the insulating body. In addition, the cable-receiving channels for the line to be connected are arranged in the cable manager.

Due to detent arms and detent indentations correlating to one another provided on the main body and/or cable manager, a connection of the two parts to form an insulating body is possible. Contact elements received in the main body are introduced into the contact region in the cable manager by joining together the main body and cable manager. Due to the insertion into the contact region, cores introduced into the cable-receiving channels are contacted with the second contact side of the contact element in an insulation-penetrating manner.

In a preferred embodiment the latching of main body and cable manager is performed in two stages. As the two parts of the insulating body are brought together, these latch firstly in a first latching stage. In this latching stage the main body and insulating body are not fully latched to one another. The contact elements received in the main body do not protrude fully via their second contact side into the contact region of the cavity in the cable manager.

The cores of an electrical conductor to be contacted can be introduced in this first latching position into the cable-receiving channels in the cable manager. By pressing together the main body and cable manager further from the first latching position into a second latching position, these are ultimately fully latched to one another. The second contact sides of the contact elements penetrate further into the contact regions of the cavities in the cable manager. The cores located in the cable-receiving channels are contacted with the second contact sides of the contact elements. An electrical connection is established between the cores of the electrical conductor and the contact elements.

BRIEF DESCRIPTION OF THE DRAWINGS

Exemplary embodiments of the invention are illustrated in the drawings and will be explained in greater detail hereinafter. In the drawings.

The figures contain partially simplified, schematic illustrations. Identical reference signs are used in part for like elements, which however might not be identical. Different views of the same elements could be scaled differently.

DETAILED DESCRIPTION OF THE INVENTION

Figure 1:
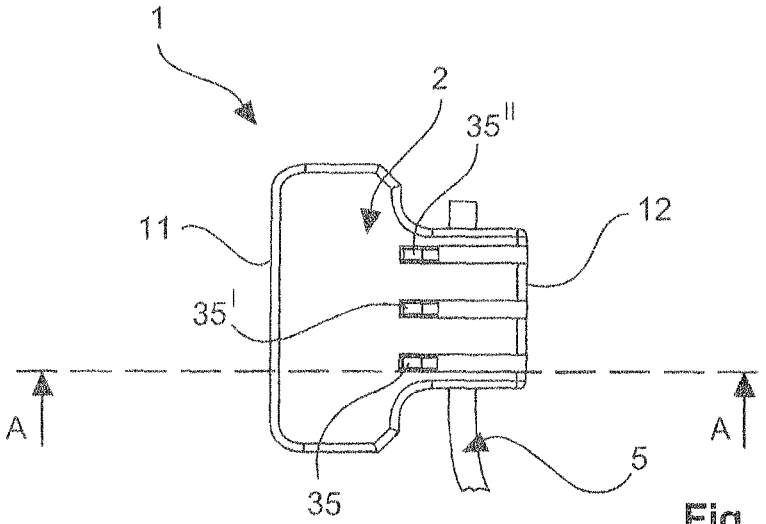
FIG. 1 shows a connector in a first embodiment in a plan view.

FIG. 1 shows the plan view of a connector 1 according to the invention in a plan view. The connector 1 is formed from an insulating body 2 which has a T-shaped basic form. The insulating body 2 forms an insertion side 11 and a contact side 12 of the connector 1.

An electrical conductor 5 is illustrated on the contact side 12 of the connector 1 and is introduced into the insulating body 2 and guided therethrough. Detent means 35, 35', 35" of three contact elements 3, 3', 3" received in the insulating body 2 can be seen centrally between the insertion side 11 and contact side 12 of the connector 1. The detent means 35, 35', 35" engage with recesses in the insulating body 2 and thus ensure a secure fit of the contact elements 3, 3', 3" in the insulating body.

Figure 2:
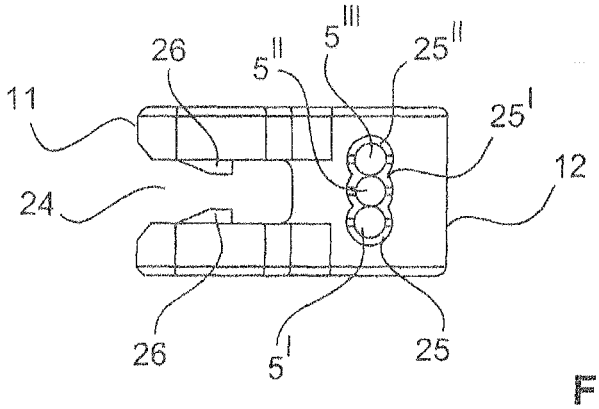
FIG. 2 shows the connector from FIG. 1 in a side view.

The connector 1 from FIG. 1 is shown in FIG. 2 from a side view. A groove 24, which passes through the entire insertion side 11, can be seen on the insertion side 11 of the connector 1. Detent shapings 26 are provided on the inner sides of the groove 24. The detent shapings 26 serve for the subsequent latching of the connector 1 to a PC board 4 (printed circuit board; PCB for short). It is possible to insert the connector 1 onto a PCB 4 by means of the tapering of the detent shapings 26 in the insertion direction.

Three cable-receiving channels 25, 25', 25" are provided on the contact side 12 of the connector 1. The partially overlapping cable-receiving channels 25, 25', 25" fully penetrate the insulating body 2. An electrical conductor 5 is illustrated here, inserted into the cable-receiving channels 25, 25', 25". The shown electrical conductor 5 is formed as a flat ribbon cable, wherein the three cores 5', 5", 5''' are arranged one in each of the cable-receiving channels 25, 25', 25".

Figure 3:
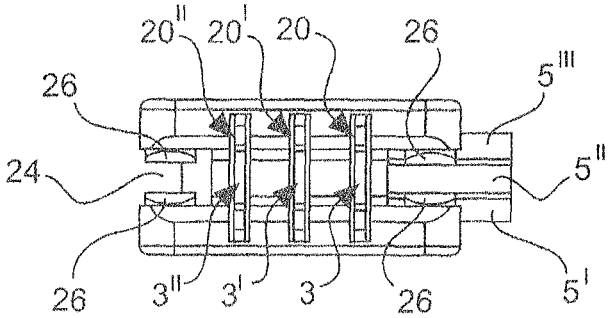
FIG. 3 shows the connector from FIG. 1 in a front view.

The connector 1 from FIG. 1 and FIG. 2 is illustrated in FIG. 3 in a further view, as considered looking at the insertion side 11 from the front. Besides the elements already illustrated and described in FIG. 1 and FIG. 2, three cavities 20, 20', 20", which are formed in the insulating body 2 in order to receive the contact elements 3, 3', 3", can be seen. Here, the cavities 20, 20', 20" extend from the insertion side 11 to the contact side 12 of the insulating body 2.

Figure 4:
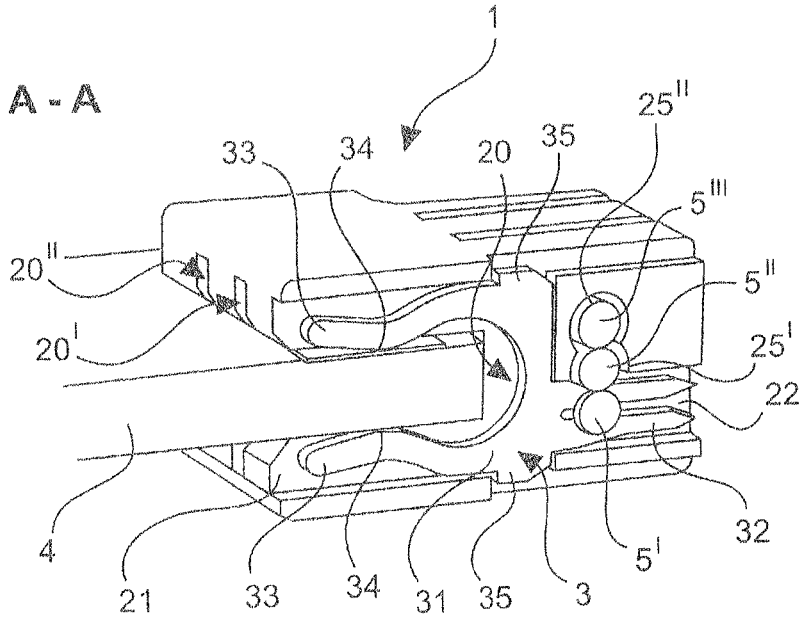
FIG. 4 shows the connector from FIG. 1 in a three-dimensional sectional illustration A-A.

In order to illustrate the mounting of the contact elements 3, 3', 3" in the cavities 20, 20', 20" in the insulating body 2, a three-dimensional sectional illustration A-A of the connector 1 from FIG. 1 is shown in FIG. 4. The section A-A shows the contact element 3 along the cavity 20.

The cavity 20 is formed from an insertion region 21 and a contact region 22. The insertion region 21 is located in the insertion-side region of the insulating body, illustrated here to the left. The contact region 22 of the cavity 20 is arranged in the contact side 12 (illustrated to the right) of the connector 1. The contact region 22 of the cavity 20 is arranged in the lower region in order to contact the lowermost core 5' of the electrical cable 5. The further contact regions 22', 22" of the two further cavities 20', 20" are arranged accordingly in another plane in order to contact the other cores 5", 5'''.

The contact element 3 consists of a left, first contact side 31 and a right, second contact side 32. The first contact side 31, consisting of two contact arms 33, is formed as a fork-shaped contact means. The first contact side 31 is arranged in the insertion region 21. The two contact arms 33 are received in the insulating body 2 above and below the slot 24. Merely one contact point 34 per contact arm 33 protrudes into the slot 24 such that it contacts an inserted PC board 4.

Two detent means 35 are provided in the middle region of the contact element 3. These engage with an undercut in the cavity 20 of the insulating body, such that the contact element 3 cannot fall out of the insulating body 2.

The second contact side 32 of the contact element 3 is formed as what is known as an insulation-displacement connector. Insulation-displacement contacts penetrate the insulating layer in order to be able to contact electrical cores around the core. This second contact side 32 is received in the contact region 22 of the cavity 20. Here, the insulation-displacement connector contacts the cores 5' of the electrical conductor 5.

The further contact elements 3', 3" (not visible) have a second contact side 32, which contact sides are located in different planes, corresponding to the cable-receiving channels 25', 25". The contact regions 22 and 22", and also the cable-receiving channels 25 and 25", may expediently be arranged such that they can be used with the same contact element 3. This contact element must be rotated merely through 180° along the cavity 20 so that the second contact side 32 is provided once in the upper region and once in the lower region.

Figure 5:
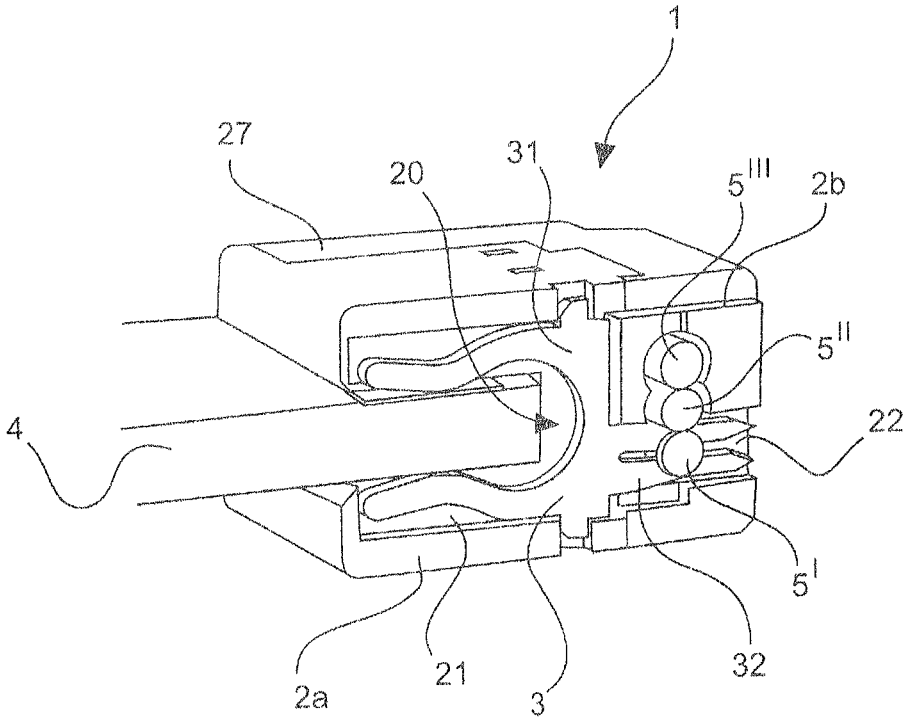
FIG. 5 shows a second embodiment of a connector in the same view as FIG. 4.

FIG. 5 shows the same view as in FIG. 4, but of a connector 1 in a second embodiment. In this second embodiment of the connector 1 the insulating body 2 is not formed in one part, but instead consists of two parts. The insulating body 2 is formed from a main body 2*a* and a cable manager 2*b*.

The main body 2*a* includes the insertion region 21 of the cavity 20. As in the one-part version, a slot 24 is provided from the insertion side 11, in which a PC board 4 is inserted as shown. The cavity 20 extends via its contact region 22 into the cable manager 2*b*. The contact element 20 can be introduced into the main body 2*a* via the separation plane though the two components (2*a*, 2*b*) of the insulating body 2. There is no need for any assembly of the contact element 20 via the insertion side 11 of the insulating body 2.

In order to lock the main body 2*a* to the cable manager 2*b*, detent arms 27 are provided. The detent arms 27 illustrated here and formed integrally on the cable manager 2*b* engage with corresponding detent means on the main body 2*a*. Detent arms 27 on the main body 2*a* that engage with detent means on the cable manager 2*b* would also be conceivable.

Figure 6:
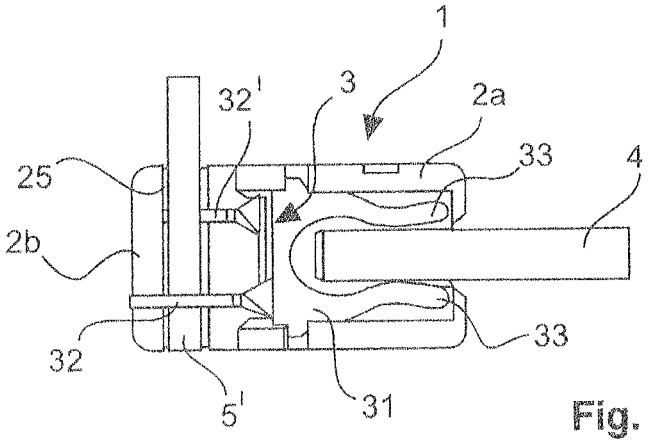
FIG. 6 shows a third embodiment of a connector in sectional side view.

A third embodiment of the connector 1 is illustrated in FIGS. 6, 7, 8 and 17. FIG. 6 shows the connector 1 in a sectional illustration, similarly to the embodiment from FIG. 5. What is different in this particular embodiment is the orientation of the second contact sides 32, 32' of the contact elements 3.

These are not formed flat in order to contact a line 5 extending parallel to the slot 24. In this embodiment the second contact sides 32, 32' are rotated or angled through 90° to the first contact side 31. The contact regions 22 and the cable-receiving channels 25 are also adapted to the orientation rotated through 90°. As a result of this orientation, an electrical conductor 5 can be introduced into the connector 1 perpendicularly from above or below.

Figure 7:
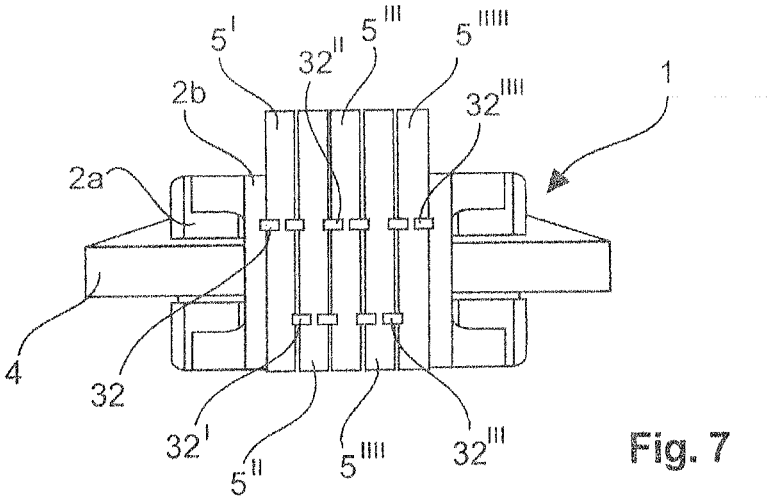
FIG. 7 shows the connector from FIG. 6 in sectional rear view.

The connector 1 from FIG. 6 is illustrated in FIG. 7 in a sectional view from the rear side. As a result of the section along the line cores, which here total 5 in number 5', 5", 5''', 5'''', 5''''', the contacting of the cores 5', 5", 5''', 5'''', 5''''' can be illustrated. The second contact sides 32, 32', 32", 32''', 32'''' rotated through 90° of the contact elements 3, 3', 3", 3''', 3'''' each intersect one of the cores 5', 5", 5''', 5'''', 5'''''.

The particular feature of the embodiment shown here is the fact that all contact elements 3, 3', 3", 3''', 3'''' are identical. As a result of the arrangement side by side and the alternating orientation of the contact elements 3, 3', 3", 3''', 3'''', only one type has to be produced, which can be used in order to contact all cores 5', 5", 5''', 5'''', 5'''''.

Figure 8:
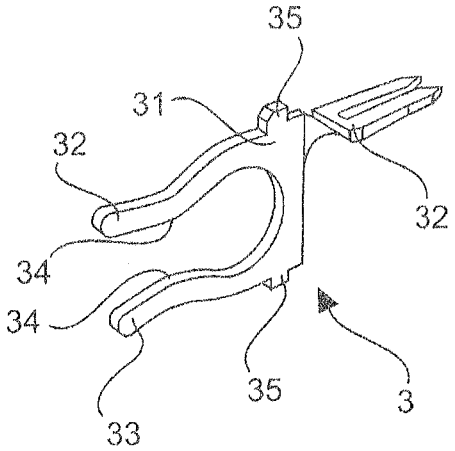
FIG. 8 shows a separated contact element of the connector from FIG. 6.

A contact element 3 of the connector 1 from FIG. 6 is shown in isolation in FIG. 8. The second contact region 32, which is rotated 90° to the first contact region 31, can be seen. Due to an embodiment of the contact element 3 as a stamped and bent part, it is easy in terms of production to rotate the two regions 31, 32 relative to one another.

The illustrated detent means 35 on the contact element 3 are provided in order to latch in a two-part insulating body 2*a*, 2*b*. Alternatively, the shown contact element 3 can also be inserted into a one-part insulating body 2. Merely the beveled sides of the detent means 35 must be directed for this purpose in the direction of the second contact side 32 so as to enable an insertion into the insulating body 2. The illustrated orientation of the beveled sides of the detent means 35 is provided from the sectional face between main body 2*a* and cable manager 2*b* for simplified insertion of the contact element 3.

Figure 17:
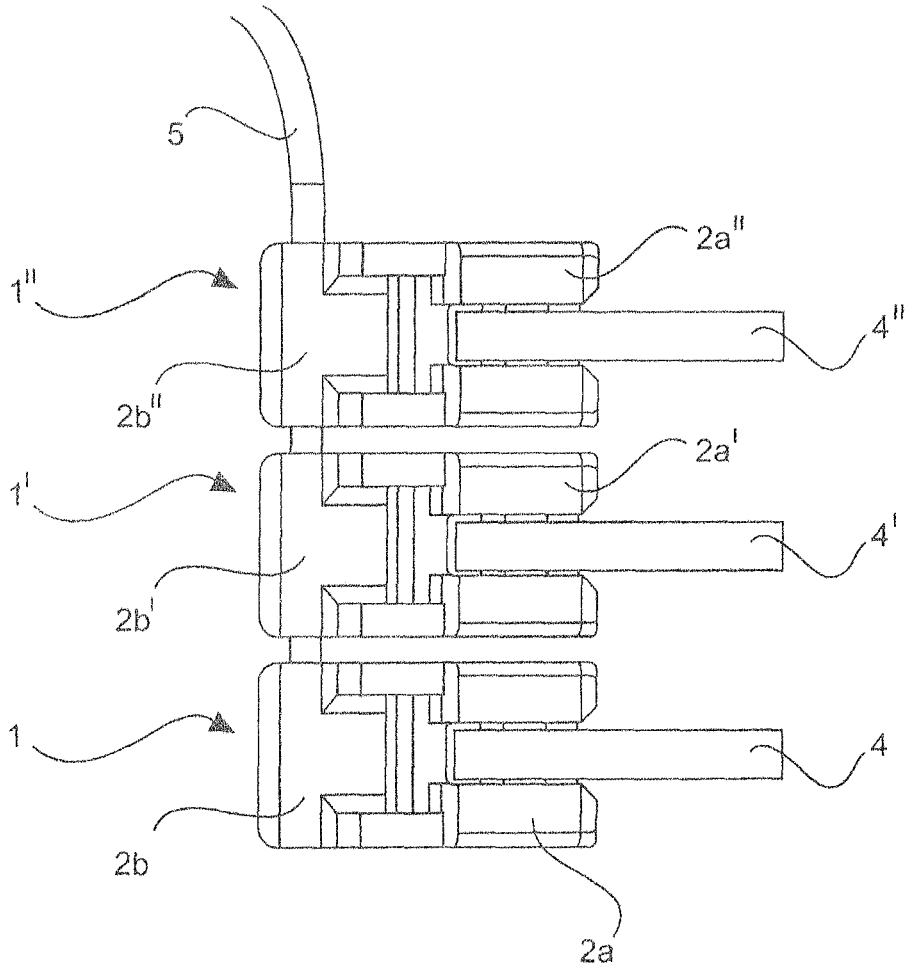
FIG. 17 shows an exemplary application of the connector from FIG. 6.

An exemplary application of the connector 1 from FIGS. 6, 7 and 8 is illustrated in FIG. 17. Due to the particularly space-saving construction of the connector 1 according to the invention, a plurality of the connectors, here three of the connectors 1, 1', 1" can be arranged very closely one above the other. Three PC boards 4, 4', 4" can thus be connected within a very confined space to a continuous conductor 5, which contacts all connectors 1, 1', 1".

With an illustrated PC board thickness of 1 mm and a height of the connectors 1, 1', 1" of approximately 3.75 mm, an overall height of the three PC boards 4, 4', 4" inclusive of connectors 1, 1', 1" of just 12.25 mm is possible. Here, even a distance between the connectors 1, 1', 1" of in each case 0.5 mm is also taken into consideration.

Figure 9:
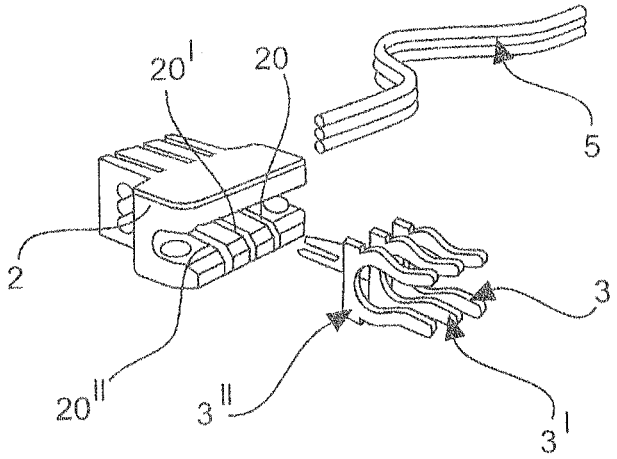
FIG. 9 shows the connector from FIG. 1 prior to assembly.
Figure 10:
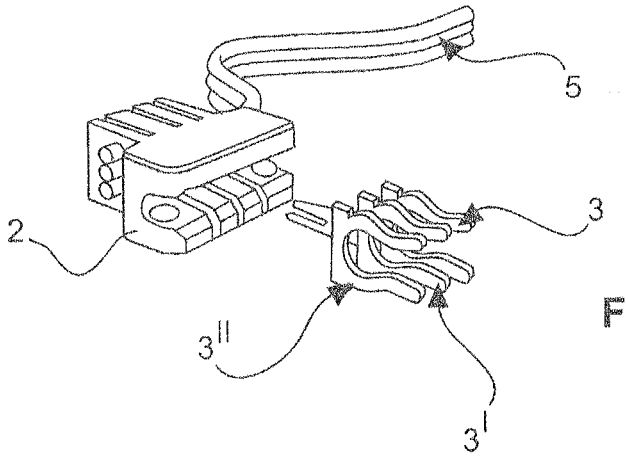
FIG. 10 shows the connector from FIG. 1 during assembly.
Figure 11:
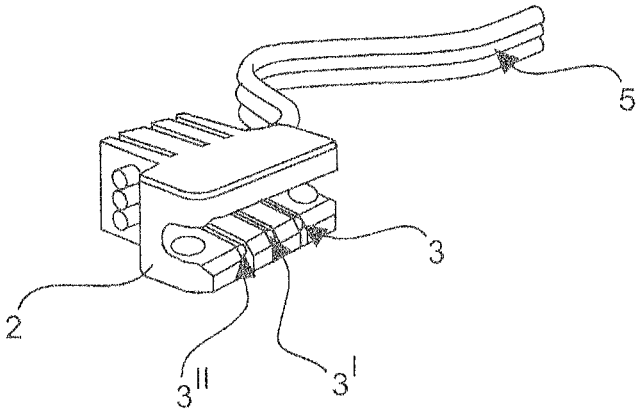
FIG. 11 shows the connector from FIG. 1 after assembly.

In FIGS. 9, 10 and 11 and in FIGS. 12, 13, 14, 15 and 16, the assembly of two different embodiments of the connector 1 according to the invention is illustrated. Here, the connector 1 from FIGS. 1 to 4 is shown in FIGS. 9, 10 and 11. The assembly of the connector 1 from FIG. 5 is shown in FIGS. 12, 13, 14, 15 and 16. However, the assembly of the connector 1 from FIG. 5 is also to be applied identically to the connectors from FIGS. 6, 7 and 17.

FIG. 9 shows the insulating body 2 and also three contact elements 3, 3', 3". The contact elements 3, 3', 3" are arranged in front of the cavities 20, 20', 20" of the insulating body 2. The contact element 3' is symmetrical. In other words, the second contact side 32' is arranged centrally relative to the first contact side 31'. The second contact side 32" is located on the contact element 3" in the upper region of the first contact side 31". The contact element 3 is identical to the contact element 3", but is rotated through 180°, such that the second contact side 32 is arranged in the lower region of the first contact side 31.

In order to assemble the connector 1, the line 5 must firstly be slid into the cable-receiving channels 25 of the insulating body 2. This is illustrated in FIG. 10. Each of the cores 5', 5", 5''' of the conductor 5 formed as a flat ribbon cable is introduced into one of the cable-receiving channels 25, 25', 25".

In FIG. 11 the contact between the cores 5, 5', 5" and the contact elements 3, 3', 3" is shown. By inserting the contact elements 3, 3', 3" into the cavities 20, 20', 20" of the insulating body 2, the second contact sides 32, 32', 32" intersect the cable-receiving channels 25, 25', 25" and the cores 5', 5", 5''' of the electrical conductor 5 received therein. The second contact sides 32, 32', 32" formed as insulation-displacement connectors penetrate the insulation of the cores 5', 5", 5''' and contact this electrically. When the contact elements 3, 3', 3" are fully inserted into the cavities 20, 20', 20", the detent means 35, 35', 35" of the contact elements 3, 3', 3" each latch in an undercut in the cavities 20, 20', 20". The contact elements 3, 3', 3" are thus prevented from falling out of the insulating body 2.

The assembly of a connector 1 having a two-part insulating body 2*a*, 2*b* from FIGS. 12, 13, 14, 15 and 16 is illustrated in greater detail in FIGS. 12 to 16.

Figure 12:
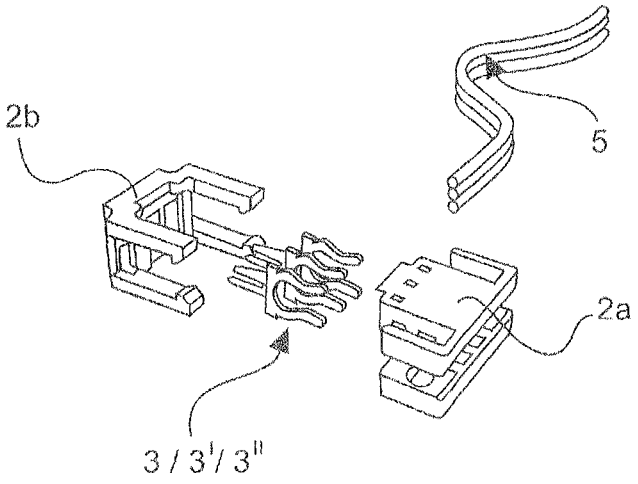
FIG. 12 shows the connector from FIG. 5 prior to assembly.
Figure 13:
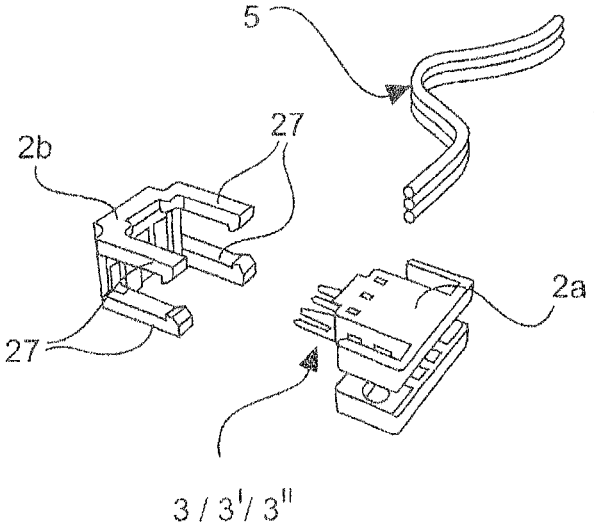
FIG. 13 shows the connector from FIG. 5 during assembly in a first assembly step.

In FIG. 12 the two-part insulating body, consisting of the main body 2*a* and the cable manager 2*b*, is shown. The contact elements 3, 3', 3" are shown therebetween. In this two-part version the contact elements 3, 3', 3" are not introduced into the main body 2*a* from the insertion side 11, but from the direction of the contact side 12. The cavities 20, 20', 20" are used for this purpose, as is also the case in the one-part version of the insulating body 2. The contact elements 3, 3', 3" are fully introduced into the main body 2*a* and latch in the main body by means of the detent means 35, 35', 35". As can be seen in FIG. 13, the second contact sides 32, 32', 32" still protrude out of the main body 2*a* in the direction of the cable manager 2*b*.

Figure 14:
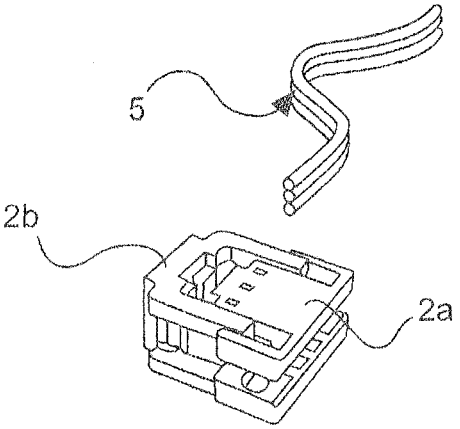
FIG. 14 shows the connector from FIG. 5 during assembly in a second assembly step.

The cable manager 2*b* is then inserted onto the main body 2*a*, as illustrated in FIG. 14. Here, the detent arms 27 serve both as a guide and as a latching mechanism. The cable manager 2*b* is not inserted fully onto the main body 2*a*. The second contact sides 32, 32', 32" of the contact elements 3, 3', 3" in this first latching stage are not yet located fully in the contact regions 22, 22', 22" of the cavities 20, 20', 20".

Figure 15:
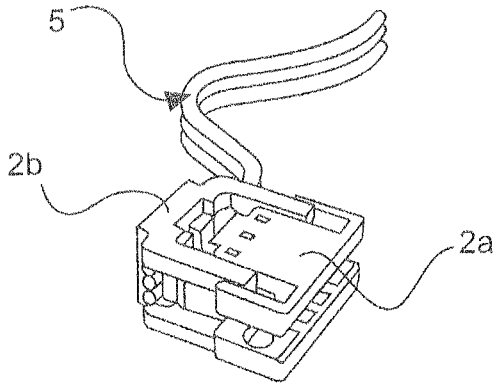
FIG. 15 shows the connector from FIG. 5 during assembly in a third assembly step.

In a third step the cores 5', 5", 5" of the electrical conductor 5 are introduced into the cable-receiving channels 25, 25', 25". In FIG. 15 the cores 5', 5", 5'" of the conductor 5 are guided fully through the cable-receiving channels 25, 25', 25".

Figure 16:
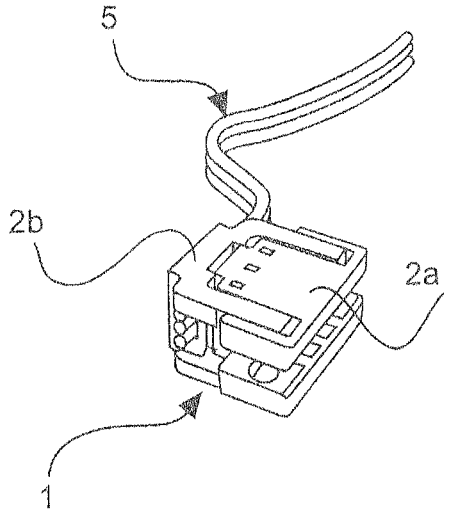
FIG. 16 shows the connector from FIG. 5 after assembly.

Lastly, as shown in FIG. 16, the cable manager 2*b* is slid fully onto the main body 2*a*. The second contact sides 32, 32', 32" thus penetrate the contact regions 22, 22', 22" fully and contact the cores 5', 5", 5'" of the conductor 5 in the cable-receiving channels 25, 25', 25". The detent arms 27 are latched in this position of the cable manager 2*b* relative to the main body 2*a* in a second latching stage.

LIST OF REFERENCE SIGNS 1 connector
11 insertion side
12 contact side
2 insulating body
2*a* main body
2*b* cable manager
20 cavity
21 insertion region
22 contact region
23 detent recess
24 slot
25 cable-receiving channel
26 detent shaping
27 detent arm
28 opening
3 contact element
31 first contact side
32 second contact side

33 contact arms
34 contact points
35 detent means
4 PC board
5 electrical conductor

The invention claimed is:

1. An electrical connector comprising an insulating body and at least one electrical contact element, wherein the insulating body has at least one cavity, which in the insulating body forms a first part formed as an insertion region and a second part formed as a contact region, wherein the contact element comprises an unitary, flat and planar stamped piece having a first contact side and a second contact side both lying in a same plane, wherein the first contact side of the contact element is adapted for contacting a PC board and the second contact side is adapted for contacting an electrical conductor in an insulation-penetrating manner, wherein the contact element is arranged in the cavity of the insulating body such that the first contact side is arranged in the insertion region and the second contact side is arranged in the contact region, wherein the first contact side of the contact element is flat and planar, fork-shaped and forms two contact arms, wherein the contact arms form two opposed contact points, wherein the contact arms of the contact side of the contact element are mirror-symmetrical to each other in both horizontal and vertical planes, and wherein the second contact side of the contact element is flat and planar, and is arranged laterally relative to the symmetry of the first contact side.

2. The electrical connector as claimed in claim 1, wherein the second contact side of the contact element is formed as a piercing or insulation-displacement contact.

3. The electrical connector as claimed in claim 1, wherein the contact element has at least one detent, which latches in a detent recess in the insulating body.

4. The electrical connector as claimed in claim 1, wherein the insulating body has at least one cable-receiving channel, wherein the cable-receiving channel crosses the at least one cavity at right angles in the contact region.

5. The electrical connector as claimed in claim 4, wherein the insulating body has a plurality of cavities arranged side by side, and the same number of cable-receiving channels arranged side by side, wherein each of the cable-receiving channels crosses exactly one of the cavities.

6. The electrical connector as claimed in claim 5, wherein the contact regions of the cavities lie in various planes each crossing a cable-receiving channel.

7. The electrical connector as claimed in claim 1, wherein the insulating body has a slot, wherein the slot intersects the insertion regions of the at least one cavity perpendicularly.

8. The electrical connector as claimed in claim 7, wherein the slot is open on three sides.

9. The electrical connector as claimed in claim 7, wherein the second contact side of the contact element is formed as a piercing or insulation-displacement contact, and the contact points of the contact arms protrude at least in regions into the slot.

10. The electrical connector as claimed in claim 7, wherein at least one detent shaping is formed on an inner side of a wall foliating the slot.

11. The electrical connector as claimed in claim 10, wherein the detent shaping is wedge-shaped or dome-like.

12. The electrical connector as claimed in claim 7, wherein the insulating body is formed in two parts, wherein a first part forms a main body, in which the insertion regions of the cavities, the slot and detent recesses are provided, and a second part forms a cable manager, in which the contact regions of the cavities and the cable-receiving channels are arranged, wherein the main body and the cable manager are adapted to be latched to one another by detent arms.

13. The electrical connector as claimed in claim 12, wherein the latching between main body and cable manager is performed in two stages, wherein in a first latching stage the second contact side of a contact element latched in the cavity is located out-side the cable-receiving channel, and in a second latching stage the second contact side intersects the cable-receiving channel.

14. The electrical connector as claimed in claim 1, wherein the insertion region of the cavity has an opening facing away from the connection region, through which opening the contact element can be introduced into the cavity.

15. The electrical connector as claimed in claim 12, wherein the insertion region of the cavity has an opening facing toward the connection region, through which opening the contact element can be introduced into the cavity.

* * * * *